US005466361A

United States Patent [19]

Heck et al.

[11] Patent Number: 5,466,361

[45] Date of Patent: Nov. 14, 1995

[54] PROCESS FOR THE DISPOSAL OF AQUEOUS SULFUR AND CAUSTIC-CONTAINING WASTES

[75] Inventors: Roland H. Heck, Pennington, N.J.; Heinz Heinemann, Oakland, Calif.; P. T. Reischman, Lambertville, N.J.; Paul B. Venuto, Yardley, Pa.; D. Duayne Whitehurst, Titusville, N.J.

[73] Assignee: Mobil Oil Corporation, Fairfax, Va.

[21] Appl. No.: 118,902

[22] Filed: Oct. 28, 1993

Related U.S. Application Data

[63] Continuation-in-part of Ser. No. 896,848, Jun. 12, 1992, abandoned.

[51] Int. Cl.[6] ..... C10G 9/00

[52] U.S. Cl. ..... 208/131; 208/13; 208/125; 208/127; 208/126; 48/197 R

[58] Field of Search ..... 208/131, 50, 126, 208/13; 48/197 R

[56] References Cited

U.S. PATENT DOCUMENTS

| | | | |
|---|---|---|---|
| 2,626,892 | 1/1953 | McCulley et al. | 196/50 |
| 3,179,584 | 4/1965 | Hamner et al. | 208/106 |
| 3,803,023 | 4/1974 | Hamner | 208/46 |
| 3,850,742 | 11/1974 | Dugan et al. | 208/131 |
| 3,915,844 | 10/1975 | Ueda et al. | 208/131 |
| 3,957,620 | 5/1976 | Fukui et al. | 208/131 |
| 4,049,538 | 9/1977 | Hayashi et al. | 208/131 |
| 4,302,324 | 11/1981 | Chen et al. | 208/131 |
| 4,479,804 | 10/1984 | Chen et al. | 208/131 |
| 4,529,501 | 7/1985 | George | 208/131 |
| 4,666,585 | 5/1987 | Figgins et al. | 208/131 |
| 4,927,524 | 5/1990 | Rodriguez et al. | 208/131 |
| 4,968,407 | 11/1990 | McGrath et al. | 208/131 |
| 5,041,207 | 8/1991 | Harrington et al. | 208/131 |
| 5,110,449 | 5/1992 | Venardos et al. | 208/131 |
| 5,114,564 | 5/1992 | Goyal | 208/131 |

OTHER PUBLICATIONS

"Oil & Gas Journal", vol. 80, No. 20, May 17, 1982, pp. 93–97.

*Primary Examiner*—Helane Myers

*Attorney, Agent, or Firm*—Alexander J. McKillop; Malcolm D. Keen; Penny L. Prater

[57] ABSTRACT

Aqueous sulfur and caustic component-containing waste streams are disposed of in an environmentally acceptable manner employing a process featuring integrated coking and gasification operations.

19 Claims, 5 Drawing Sheets

PROCESS FOR THE DISPOSAL OF AQUEOUS SULFUR AND CAUSTIC-CONTAINING WASTES

CROSS-REFERENCE TO RELATED APPLICATION

This is a continuation-in-part of application Ser. No. 07/896,848, filed Jun. 12, 1992 now abandoned, which is incorporated herein by reference in its entirety.

FIELD OF THE INVENTION

This invention relates to a process for the environmentally acceptable disposal of aqueous sulfur and caustic containing-wastes, e.g., those resulting from a variety of petroleum refinery operations. More particularly, the invention relates to an integrated process for disposing of such wastes employing a coking operation featuring co-injection of the wastes with the coker feed streams followed by gasification of the resulting coke product.

BACKGROUND OF THE INVENTION

The coking of low value heavy petroleum streams, e.g., a vacuum resid, is a known process for upgrading such materials. In a common type of coking process, delayed coking, a heavy oil feedstock is heated rapidly in a fired heater or tubular furnace from which it flows directly to a large coking drum which is maintained under conditions at which coking occurs, generally with temperatures above 450° C. under a slightly superatmospheric pressure. It is usual practice to employ two coking drums with one drum being charged with feedstock while product coke is being removed from the other drum.

In accordance with commonly assigned, copending U.S. patent application Ser. No. 07/779,657, filed Oct. 21, 1991, refinery-derived alkali-containing aqueous waste streams can be added to a delayed coking unit during coking to produce lighter, lower boiling products and an alkali metal-containing coke product. The waste streams can be those resulting from such refinery operations as Merox treating, caustic scrubbing, mercapfining and hydrogen sulfide removal from liquid and gaseous petroleum products.

U.S. Pat. No. 3,179,584 (Hamner et al.) discloses that the addition of a caustic material such as an aqueous solution of sodium hydroxide or potassium hydroxide to a heavy oil feedstock in a coking operation increases the amount of hydrogen formed during coking. The carbonate or oxide form of the alkali metal is also said to be useful.

U.S. Pat. No. 3,803,023 (Hamner et al.) describes a process for coking a heavy carbonaceous feed, e.g., a resid, in a coking zone in the presence of an alkali metal compound, e.g., the hydroxide, carbonate, sulfide, silicate or organic salts of potassium, sodium, lithium, rubidium and cesium, to provide an alkali metal-containing coke, gasifying at least a portion of the coke in a separate gasification zone in the presence of steam to convert at least a portion of the coke to a gaseous product and to obtain a partially gasified alkali metal-containing coke, passing the partially gasified coke to the coking zone and coking additional heavy carbonaceous feed in the coking zone where the resulting coke deposits on the partially gasified alkali metal-containing coke. The presence of alkali metal in the gasification zone results in increased gas yields. The gas contains over twice as much $CO_2$, about half as much CO and less than half as much methane.

It is notable that '023 teaches the gasification of coke containing an alkali sulfide wherein the alkali sulfide is added to a heavy resid (coker feed) prior to coking. The alkali sulfide is not disclosed in '023 as being a component in an aqueous waste stream as disclosed in the instant invention. Furthermore, in the instant invention, residuum (coker feed) treated with water during the coking stage yields higher conversion during subsequent gasification of the coke than coke formed from residuum wherein only catalyst and no water is used to treat the residuum.

U.S. Pat. No. 2,626,892 (McCulley et al.) teaches the cracking of residual fractions containing an excess of salts, such as sodium sulfonates and naphthenates resulting from caustic treatment. Coke is formed by use of the McCulley process, the coke containing a salt residue. McCulley does not mention the presence in the residual fractions being cracked of sulfides or of any compounds which, upon gasification, would yield hydrogen sulfide. The presence of sulfides in the waste stream injected with the coke is a crucial element of the instant invention.

McCulley does not state that sulfides are inherently present in the McCulley reactant streams in any amount, either at a contaminant level or in operating amounts. McCulley does not add alkali compounds to the resid (coker feed) being treated. McCulley regards these compounds as being deleterious and seeks to remove these compounds from a petroleum fraction having an excess of alkali salts by cracking in a vessel to form a coke which carries the compounds from the cracked products. Furthermore, McCulley does not contemplate subsequent gasification of the coke. McCulley differs from Hamner '023 and the instant invention in that it considers alkali compounds to be deleterious and does not deliberately add them.

SUMMARY OF THE INVENTION

It has now been discovered that when environmentally hazardous aqueous wastes containing sulfur and caustic components are co-injected with a coker feedstock in a coking operation followed by gasification of the resulting sulfur and caustic component-containing coke product, gasification proceeds much more rapidly, the sulfur-containing component of the coke is converted largely to hydrogen sulfide which in turn can be readily converted to elemental sulfur suitable for sale and the caustic-containing component(s) are converted to an environmentally acceptable solid residue.

Accordingly, there is provided in accordance with the instant invention a coking process which provides for the environmentally acceptable disposal of an aqueous waste material comprising:

(a) reacting a coker feedstock under coking conditions to form a coke product in the presence of an aqueous waste material containing from 0.4 wt. % to 25 wt. % of at least one sulfur-containing component which on gasification converts to hydrogen sulfide, and at least one alkali metal containing component, wherein the coker feedstock comprises a hydrocarbon fraction having a boiling point of at least about 650F and wherein said coking reaction conditions include a temperature of from about 800° to about 930° F.; and (b) gasifying the coke product under gasification conditions in the presence of a catalyst, said catalyst comprising at least one metal oxide selected from the group consisting of alkali metal oxide and alkaline earth metal oxide, in order to convert (i) the coke to gaseous products, (ii) the sulfur-containing component to hydrogen sulfide and (iii) the alkali metal-containing component to a solid residue.

The hydrogen sulfide resulting from the gasifying operation may be readily converted to elemental sulfur, suitable for sale, employing known and conventional procedures. Thus, the present invention provides an environmentally safe, economically attractive process for disposing of hazardous waste streams, particularly those associated with the refinery operations mentioned above, while at the same time providing gaseous products useful as furnace fuel, fuel for power generation, for hydrogen production or as syngas for chemicals.

DESCRIPTION OF THE PREFERRED EMBODIMENTS

Figure 1:
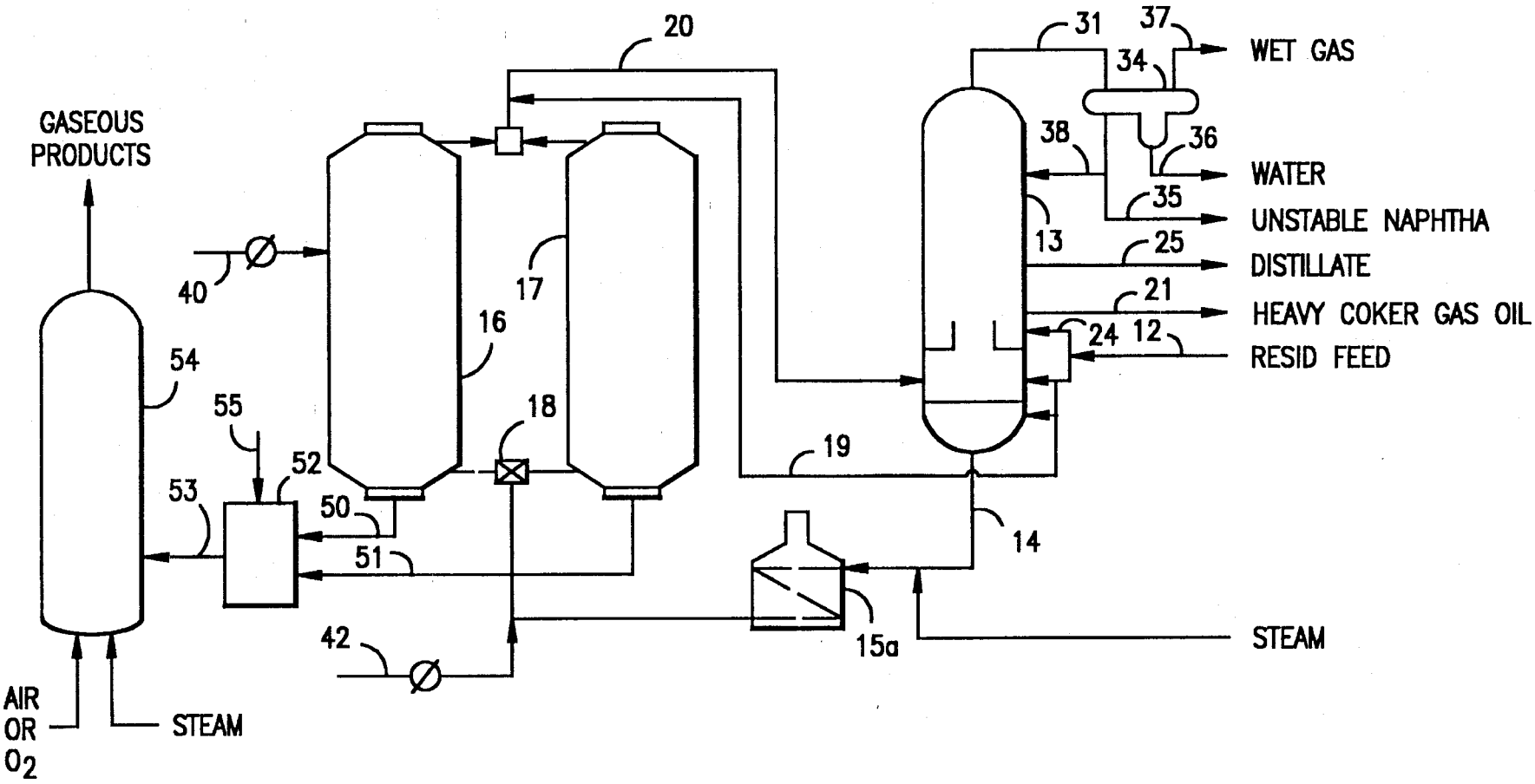
FIG. 1 is a simplified schematic representation of the aqueous waste disposal process of the invention.

Sources of aqueous sulfur-containing and caustic-containing waste materials which can be used in the coking operation of the present invention include those containing caustic soda and potash. Preferably, these are the spent alkali metal waste streams resulting from the refining of heavy hydrocarbons to lighter hydrocarbon products. Examples are spent caustics from Merox treating, caustic scrubbing, mercapfining and hydrogen sulfide removal from liquid products or gases. The alkali metal-containing materials from these processes contain water, alkali metals, generally sodium and/or potassium, sulfur compound(s) and other wastes including organic contaminants. These spent sulfur and alkali metal-containing waste materials typically possess a hydrocarbon content of <10 wt. %. Such waste materials pose disposal problems because they are incompatible with the natural environment. Moreover, the available disposal means are limited due to the harmfulness of the alkali metals, sulfur species and organic contaminants. Although incineration and oxidation in the liquid phase are fairly safe methods of treatment for disposal, a secondary beneficial application for these materials would be preferred. The high sulfur contents which are typical of these waste streams present additional problems in that incinerating or scrubbing the exhaust gas to remove sulfur oxides is inefficient and costly. Although refinery caustic soda and/or caustic potash are most effective in the process, it is contemplated that other sulfur and alkali-metal containing waste materials which are encountered in refinery operations can also be employed.

The coking operation of the waste disposal process herein will hereinafter be more fully described in connection with the delayed coking process schematically illustrated in FIG. 1. It will, of course be recognized that coking can be carried out by other known procedures, e.g., flexicoking as described in *Oil and Gas Journal,* Vol. 80, No. 20, May 17, 1982, pp. 93 et seq.

In a delayed coking process, a heavy oil feedstock is heated rapidly in a tubular furnace to a coking temperature which is usually at least 425° C. (about 800° F.) and, typically 425° C. to 500° C. (about 800° F. to 930° F.). From there it flows directly to a large coking drum which is maintained under conditions at which coking occurs, generally with temperatures of about 430° C. to 450° C. (about 800° F. to 840° F.) under a slight superatmospheric pressure, typically ranging from 0–100, or 5–100 psig. In the furnace and coking drum, the heated feed thermally decomposes to form coke and volatile liquid products, i.e., the vaporous products of cracking which are removed from the top of the drum and passed to a fractionator.

Typical examples of coker petroleum feedstocks which are contemplated for use in the coking operation of this invention include residues from atmospheric or vacuum distillation of petroleum crudes or the atmospheric distillation of heavy oils, visbroken resids, tars from deasphalting units or combinations of these materials. Typically, these feedstocks are high-boiling hydrocarbons that have an initial boiling point of about 650° F. or higher and an API gravity of about 0° to 20° and a Conradson Carbon Residue content of about 0 to 40 weight percent.

The sulfur and alkali metal-containing waste material is added downstream of the coker heater. Thus, the waste material can be added before the coker drum or directly to the coker drum through its own dedicated nozzle. However, to avoid premature quenching of the coker feedstock, the waste material can be introduced to the process stream i.e., the heated hydrocarbon feedstock, at a rate and temperature sufficient to avoid quenching the feedstock conversion. When the waste material is trickled into the process stream at a slow rate, the temperature of the material can range from ambient temperature (about 70° F.) to a slightly elevated temperature, i.e., about 100° F. to 175° F., up to the temperature of the process stream or the coking feedstock; that is, as high as 930° F. The waste material should not be heated to a temperature which is high enough to promote deposition of the alkali metal compounds in the lines used to convey the material to the process stream.

A delayed coker unit which is suitable for use in the coking operation of this invention is shown in FIG. 1. The heavy oil feedstock enters the unit through conduit 12 which brings the feedstock to the fractionating tower 13, entering the tower below the level of the coker drum effluent. In many units the feed also often enters the tower above the level of the coker drum effluent. The feed to the coker furnace, comprising fresh feed together with the tower bottoms fraction, generally known as recycle, is withdrawn from the bottom of tower 13 through conduit 14 through which it passes to furnace **15*a* where it is brought to a suitable temperature for coking to occur in delayed coker drums 16 and 17, with entry to the drums being controlled by switching valve 18 so as to permit one drum to be on stream while coke is being removed from the other. The vaporous products of the coking process leave the coker drums as overheads and pass into fractionator 13 through conduit 20, entering the lower section of the tower below the chimney. Quench line 19 introduces a cooler liquid to the overheads to avoid coking in the coking transfer line 20**.

Heavy coker gas oil is withdrawn from fractionator 13 and leaves the unit through conduit 21. Distillate product is withdrawn from the unit through conduit 25. Coker gas leaves the top of the column through conduit 31 passing into separator 34 from which unstable naphtha, water and wet gas are obtained, leaving the unit through conduits 35, 36 and 37 with a reflux fraction being returned to the fractionator through conduit 38.

The sulfur and alkali metal-containing waste material is introduced to the coker process stream downstream of the coker furnace. The waste material can be heated and added directly to the coke drum during filling through leading line 40 which can be at any of several levels of the drum. Alternatively, the alkali waste material is introduced to the coker-drum feed through line 42. In an alternative embodiment, the waste material is introduced through both lines 40 and 42. Up to about 5000 ppm or more of the waste material is introduced to the delayed coking unit.

In general, the feed present in the coker will contain less than about 5 weight percent alkali metal compound added as the waste sulfur and alkali metal-containing stream, preferably less than about 4 weight percent alkali metal compound and still more preferably less than about 3 weight percent alkali metal compound. In order to provide satisfactory gasification, it is desirable that at least 0.5 wt. % alkali metal compound be incorporated into the final coke. Levels of sodium in coke that are over 20% are not desirable because of possible corrosion problems. Most sulfur component(s) and inorganic contaminants in the alkali metal-containing material are incorporated into the coke as minor contaminants while any organic components of the material are incorporated into the light coker products. A typical waste stream often contains at least 1 weight percent sulfur in the form of alkaline sulfide(s) or hydrosulfide(s). (Table 2 of Examples 4–6 provides an analysis of a typical spent caustic stream.) Some of the sulfur components may be evolved as hydrogen sulfide in the coking reactor which is conveniently trapped in the gas cleaning plant. The level of sulfur in a waste alkali stream is preferably from 0.4 wt % to 13 wt. %, and more preferably from 1 wt. % to 10 wt. %, although, as Table 2 demonstrates the sulfur level could be as high as about 25%.

When the waste material is heated, heating is conducted in a heater dedicated to the waste stream and separate from the heater dedicated to the coker feed. Heating the waste stream together with the coker feed in the heater dedicated to the coker feed is undesirable because the caustic component(s) of the waste will promote premature coking which at worst can permanently damage the heater and feedlines and at best will cause production delays by increasing the downtime necessary to decoke the coker feed heater and process lines. The waste stream heater can be a tubular furnace, fired heater or other suitable apparatus.

There are basically three different types of solid coker products which are different in value, appearance and properties. They are needle coke, sponge coke and shot coke. Needle coke is the highest quality of the three varieties. Needle coke, upon further treatment, has high conductivity and is used in electric arc steel production. It is low in sulfur and metals and is produced from some of the higher quality coker charge stocks which include more aromatic feedstocks such as slurry and decant oils from catalytic crackers and thermal cracking tars as opposed to the asphaltenes and resins.

Sponge coke, a lower quality coke, sometimes called "regular coke", is most often formed in refineries. Low quality refinery coker feedstocks having significant amounts of asphaltenes, heteroatoms and metals produce this lower quality coke. If the sulfur and metals content is low enough, sponge coke can be used for the manufacture of electrodes for the aluminum industry. If the sulfur and metals content is too high, then the coke can be used as fuel. The name "sponge coke" comes from its porous, sponge-like appearance.

Shot coke has been considered the lowest quality coke because it has the highest sulfur and metals content, the lowest electrical conductivity and is the most difficult to grind. The name shot coke comes from its shape which is similar to that of B-B sized balls. The shot coke has a tendency to agglomerate into larger masses, sometimes as much as a foot in diameter which can cause refinery equipment and processing problems. Shot coke is made from the lowest quality high resin-asphaltene feeds and makes a good high sulfur fuel source. It can also be used in cement kilns and steel manufacture.

It has been found that adding caustic in accordance with the invention has a beneficial effect on the coking process and the coke product. The refiner can predict with better accuracy the morphology of the coke product because the caustic drives the coke drum to shot coke with a reasonable degree of predictability. Since "hot drum" problems are mostly an issue when the coke morphology is unknown and when there is a mixture of morphologies in the drum; i.e., shot coke and needle coke and/or sponge coke, the advantage to the refiner of knowing that the drum contains uniformly shot coke outweighs the value of running the unit to produce higher quality coke. Moreover, the significant expense to the refiner of producing more valuable coke by introducing more expensive feeds to the coker unit places greater importance on improving the process for making shot coke. Also, the addition of caustic soda or caustic potash can enable the refiner to run the delayed coking unit at lower operating temperatures. That is, a high temperature and low pressure will ordinarily drive the drum towards the manufacture of shot coke. The addition of caustic produces a drum of shot coke at a lower operating temperature which is an economical advantage to the refiner.

The refinery-derived alkali metal-containing material is a small waste stream which is relatively low in volume amount compared to the amount of the coker feedstock. The amount will also vary depending upon availability. Thus, the alkali material can be added to the unit continuously or in intermittant intervals based on availability.

The process maximizes recovery of volatile organics from the coke by coking at lower hydrocarbon partial pressure and by promoting steam stripping. The water which is in the spent caustic in significant amounts turns to steam during preheating or upon introduction to the coker drum. This facilitates stripping of the volatile organics contained in the spent caustic coke feed. The steam also encourages the drum to generate shot coke.

The formation of shot coke in accordance with this invention is advantageous because the caustic accelerates drum cooling making shot coke a safe and efficient coker product.

In another embodiment of the coking operation, the spent sulfur and alkali metal-containing waste material can be used to quench the hot coke. In this manner, the waste material is added to the quenching fluid, usually water, to quench the coke prior to its removal. The hydrocarbon constituent (usually <10% by weight) can be recovered in the reaction blowdown.

In the process illustrated in FIG. 1, while coker drum 17 is filling with coke, coke is removed from coker drum 16 through conduit 50. Later, coke will be removed from coker drum 17 through conduit 51 while drum 16 is filling with coke. The coke alternately removed from drums 16 and 17 is ground in fine grinder unit 52 prior to introduction through conduit 53 to gasifier 54 which can be operated with steam and/or oxygen (conveniently supplied as air) with or without added gasifying catalyst in a known manner to provide gaseous products for use as fuel, chemical feedstocks, etc. Suitable gasifying conditions include a temperature of from about 550° to about 700° C. and a pressure of from about atmospheric to about 2000 psig.

Preferably, the gasifying operation employs added gasifying catalyst comprising an alkali metal oxide, e.g., an oxide of lithium, sodium and/or potassium, an alkaline earth metal oxide, e.g., an oxide of calcium and/or magnesium, or a mixture of alkali metal oxide and alkaline earth metal oxide. The added gasifying catalyst can be introduced into the coke either during the coking operation, e.g., through line 40, or after the product coke has been removed from the drum, e.g., through line 55. Mixtures of potassium oxide and calcium oxide or sodium oxide and calcium oxide are particularly advantageous since they are believed to form a thin eutectic phase which provides good wetting of the coke particles during gasification. In the instant invention, the term "eutectic" describes a combination of materials that has a lower melting point than that of either of the two components alone. The amounts of such gasifying catalysts and the relative proportions of alkali metal oxide to alkaline earth metal oxide where mixtures of these oxides are employed can vary widely. In general, from about 0.1 to about 5 weight percent, and preferably from about 0.5 to about 2 weight percent, of added gasifying catalyst containing, in the case of oxide mixtures, from about a 1:4 to about a 4:1 molar ratio of alkali metal oxide to alkaline earth metal oxide can be used with generally good results.

The gasifying operation converts the coke to gaseous products, the sulfur-containing component(s) to reduced sulfur, largely hydrogen sulfide, and the alkali metal-containing component(s) to a solid residue which, if desired, can be recycled to the gasifying operation. The hydrogen sulfide can be recovered and converted to environmentally acceptable products employing any of a variety of known processes. Thus, e.g., the hydrogen sulfide can be converted to elemental sulfur, a product having commercial value, employing the Claus process.

EXAMPLE 1

This example and Examples 2 and 3 which follow illustrate a coking operation carried out in a laboratory autoclave under conditions which simulate a delayed coker unit.

About 50 grams of coker feedstock, a vacuum resid, was fed to the autoclave and maintained at delayed coking conditions of 840° F. and 12 psig. Four grams of water were added to the coker to provide comparable conditions to caustic coking but without the presence of alkali metals (e.g., NaOH). During coking, the coke make versus time was evaluated at intervals to determine the rate of coke production. The results are presented in the graph shown in FIG. 2.

EXAMPLE 2

Delayed coking of a feedstock was conducted in a manner similar to Example 1, except that 4 grams of 10% NaOH solution were added to the autoclave along with the coker feedstock. During coking, the coke make versus time were evaluated at intervals to determine the rate of coke production. The results are presented in the graph shown as FIG. 2.

EXAMPLE 3

Delayed coking of a feedstock was conducted in a manner similar to Example 2, except that 4 grams of a refinery-derived waste caustic were fed to the autoclave along with the coker feedstock. The coke make versus time was evaluated at intervals to determine the rate of coke production. The results are also presented in the graph shown in FIG. 2.

Figure 2:
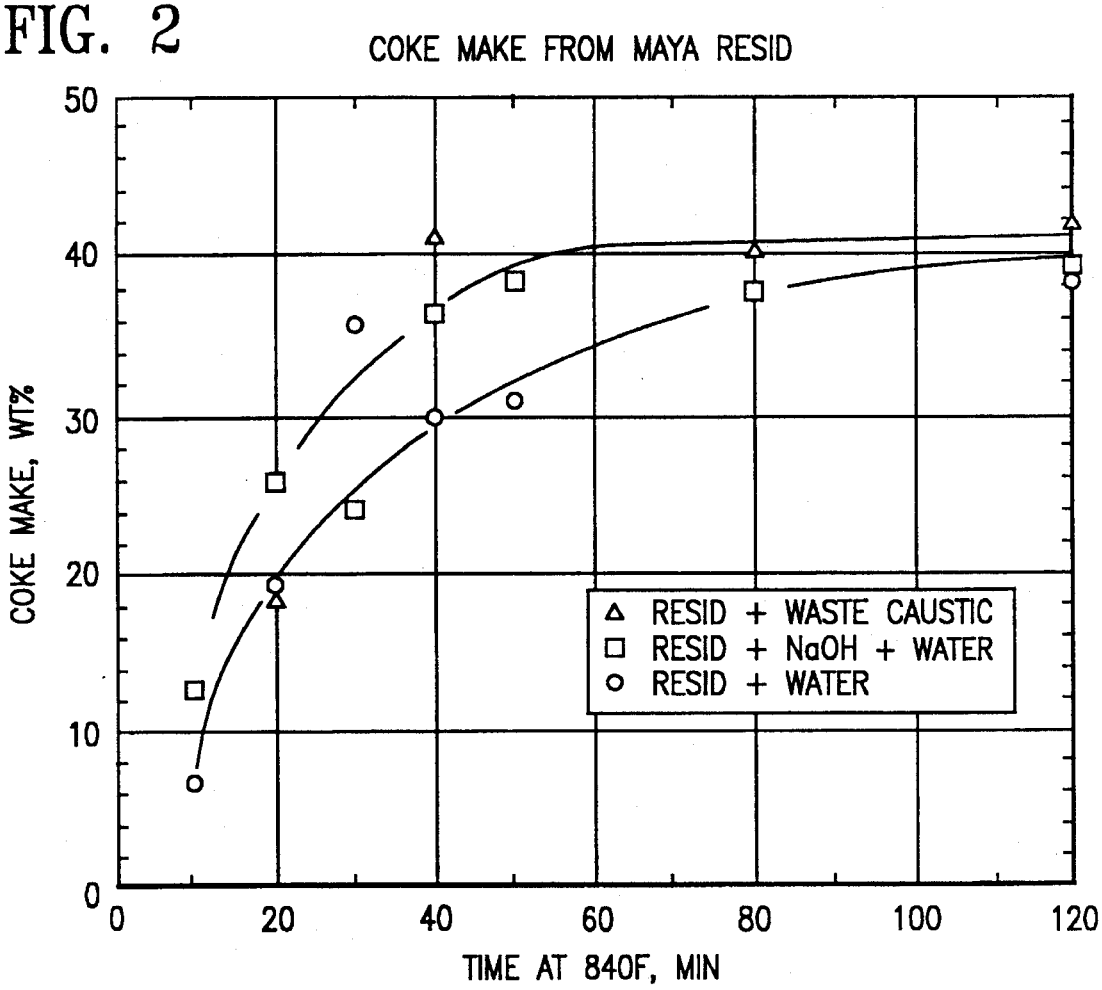
FIG. 2 is a plot of coke make in weight vs. time for a laboratory scale batch coker unit; and, FIGS. 3–8 are graphical presentations of the results of various gasifying operations carried out upon different cokes in the presence and absence of added gasifying catalyst.

The weight % coke make v. time plot of FIG. 2 which was determined from the data collected from the runs of Examples 1–3, and the coke yields at various intervals show that adding fresh or spent caustic to a delayed coker drum while conducting delayed coking of a feedstock increases the coke production rate compared to the rate of coke production from coke made in the conventional manner but does not substantially increase the overall coke yield.

EXAMPLES 4–6

A vacuum resid having the elemental analysis set forth in Table 1 was coked in a series of three separate runs in a laboratory autoclave at 840° F. and 12 psig with times ranging from 10 minutes to 2 hours. In the coking operation of Example 4, 7 weight percent water was added to the resid. In the coking operation of Example 5, 7 weight percent of 10 weight percent aqueous sodium hydroxide was added, and in the coking operation of Example 6, 7 weight percent of a refinery spent caustic having the analysis set forth in Table 2 was added.

TABLE 1

| Elemental Analysis of Vacuum Resid | |
|---|---|
| C, wt. % | 82.98 |
| H, wt. % | 9.57 |
| N, wt. % | 0.73 |
| O, wt. % | 0.46 |
| S, wt. % | 5.35 |
| Ni, ppm | 105 |
| V, ppm | 665 |

TABLE 2

| Analysis of Refinery Spent Caustic | |
|---|---|
| By-Products and Solvents | 2% |
| Sodium Bicarbonate | 1% |
| Water | 70% |
| Hydrogen Sodium Sulphide | 23% |

Table 3 sets forth the weight percent coke produced in each coking operation.

TABLE 3

| | Results of Coking Vacuum Resid | | |
|---|---|---|---|
| Time min | Example 4 | Example 5 | Example 6 |
| 10 | 6.8 | 12.6 | — |
| 20 | 19.4 | 26.0 | 18.6 |
| 30 | 35.8 | 24.4 | — |
| 40 | 30.0 | 36.4 | 41.0 |
| 50 | 31.0 | 38.4 | — |
| 80 | 37.7 | 37.8 | 40.2 |
| 120 | 38.4 | 39.2 | 41.8 |

These data demonstrate that the presence of caustic during coking increases the rate of coke formation.

Table 4 sets forth the crystallinities (a measurement of coke quality) of the cokes of Examples 4–6 as determined by powder X-ray diffraction (XRD).

TABLE 4

| Crystallinities of Cokes Obtained from Vacuum Resid | | | |
|---|---|---|---|
| Time min | Example 4 | Example 5 | Example 6 |
| 10 | 7.1% | 6.2% | — |
| 20 | 8.8 | 8.4 | 6.6% |
| 30 | 12.7 | 8.1 | — |
| 40 | 9.8 | 7.0 | 8.8 |
| 50 | 11.0 | 9.8 | — |
| 80 | 13.2 | 10.3 | 8.5 |
| 120 | 10.0 | 9.9 | 8.6 |

These data show that with caustic present, the coking operation produced a coke having relatively low crystallinity compared with, say, a graphitic coke. Such a low crystallinity coke is often referred to as shot coke.

The coke products of Examples 4–6 were then subjected to gasification at 600° C. and a water rate of 8 cc/gm/coke/hr in the presence and absence of added potassium/calcium oxide (1% equimolar $KO_x$ and $CaO_x$) catalyst.

Figure 3:
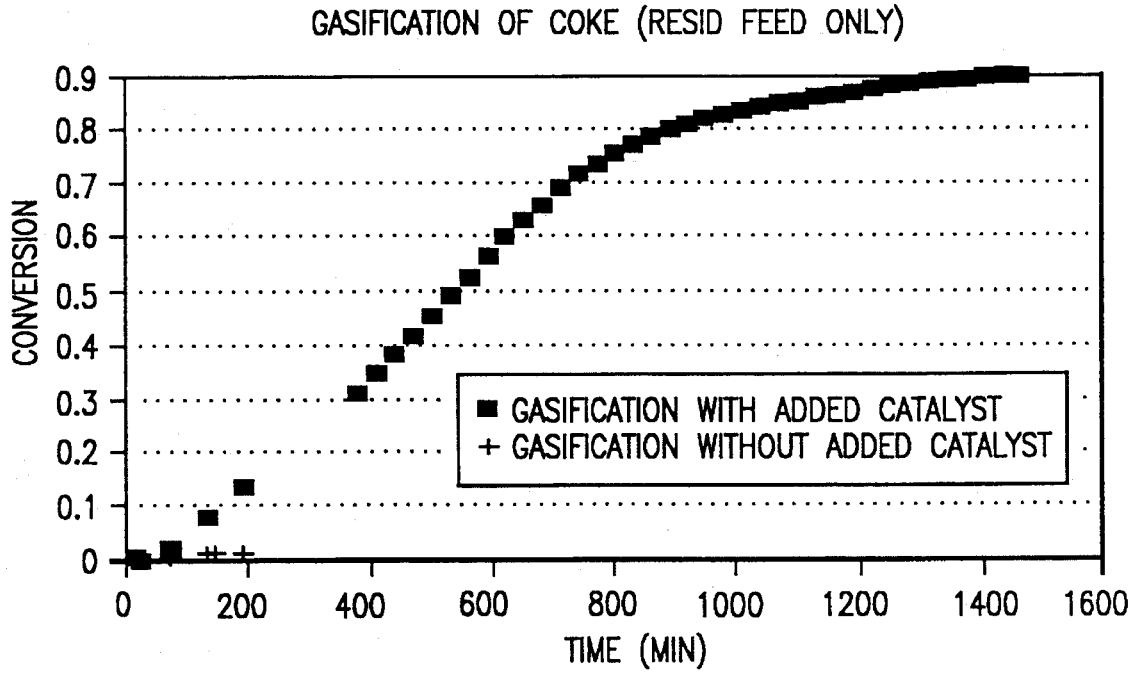

FIG. 3 shows the results of gasification carried out in the presence and absence of catalyst upon a coke derived from the resid feed only to which no water, sodium hydroxide or caustic was added. Almost no gasification occurred in the absence of added catalyst and essentially complete conversion could be obtained in the presence of added catalyst in about 1000 minutes.

Figure 4:
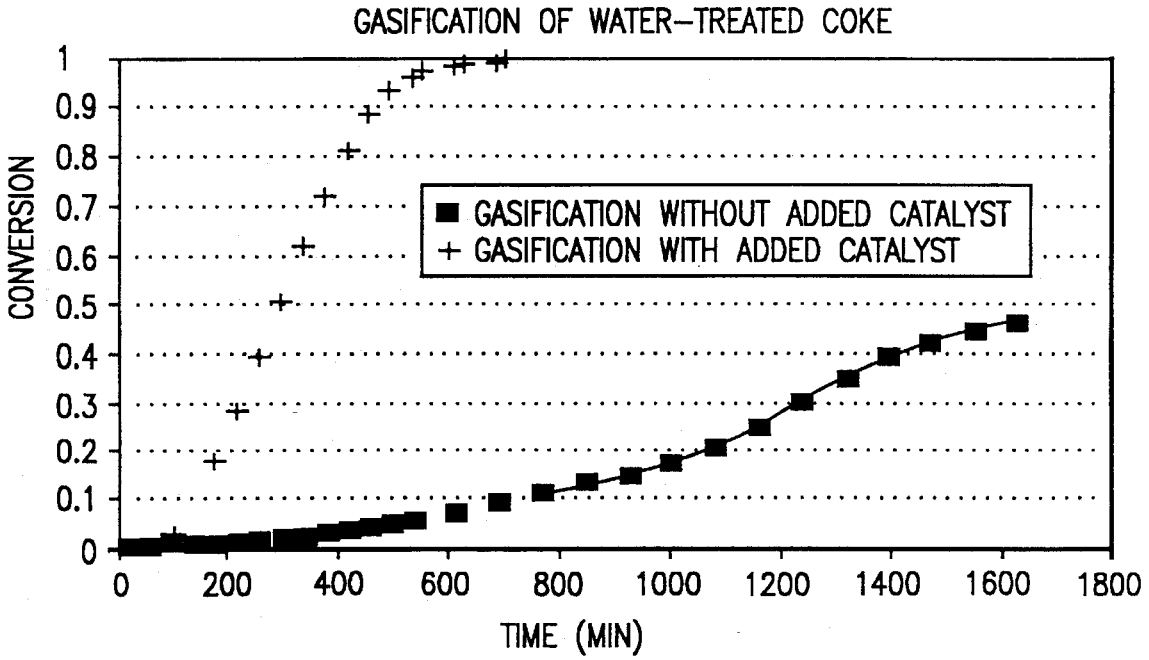

FIG. 4 shows the results of gasification carried out in the presence and absence of added catalyst upon the coke of Example 4. In the absence of added catalyst, gasification was extremely slow but better than with the coke of FIG. 3. In the presence of added catalyst, the coke of Example 4 gave excellent gasification going to completion in about 600 minutes.

Figure 5:
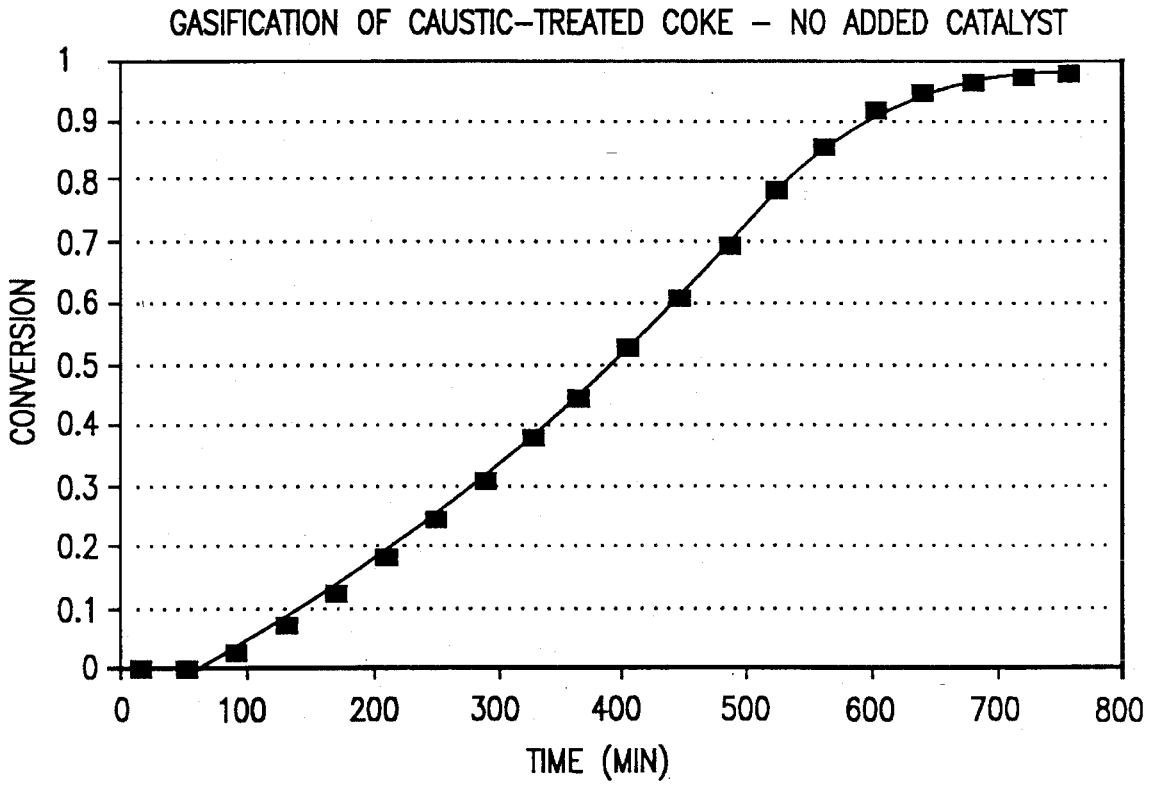
Figure 6:
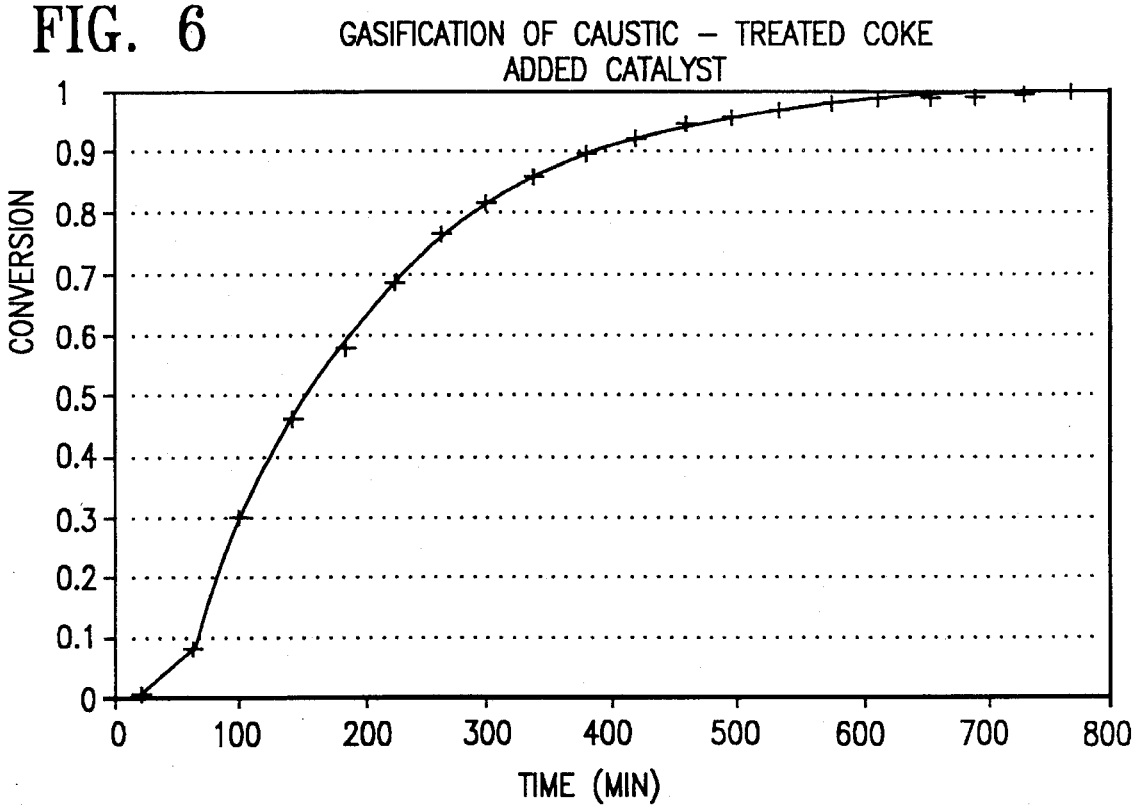

FIG. 5 shows the gasification of the cokes of Examples 5 and 6 in the absence of catalyst and FIG. 6 shows their gasification in the presence of added catalyst. The gasification rate of the cokes of Examples 5 and 6 shows great improvement over the rates shown in FIGS. 3 and 4 with added catalyst further improving the rate. Thus, 90% conversion is achieved in the absence of added catalyst in 600 minutes while in the presence of added catalyst, 90% conversion is achieved in 400 minutes.

Figure 7:
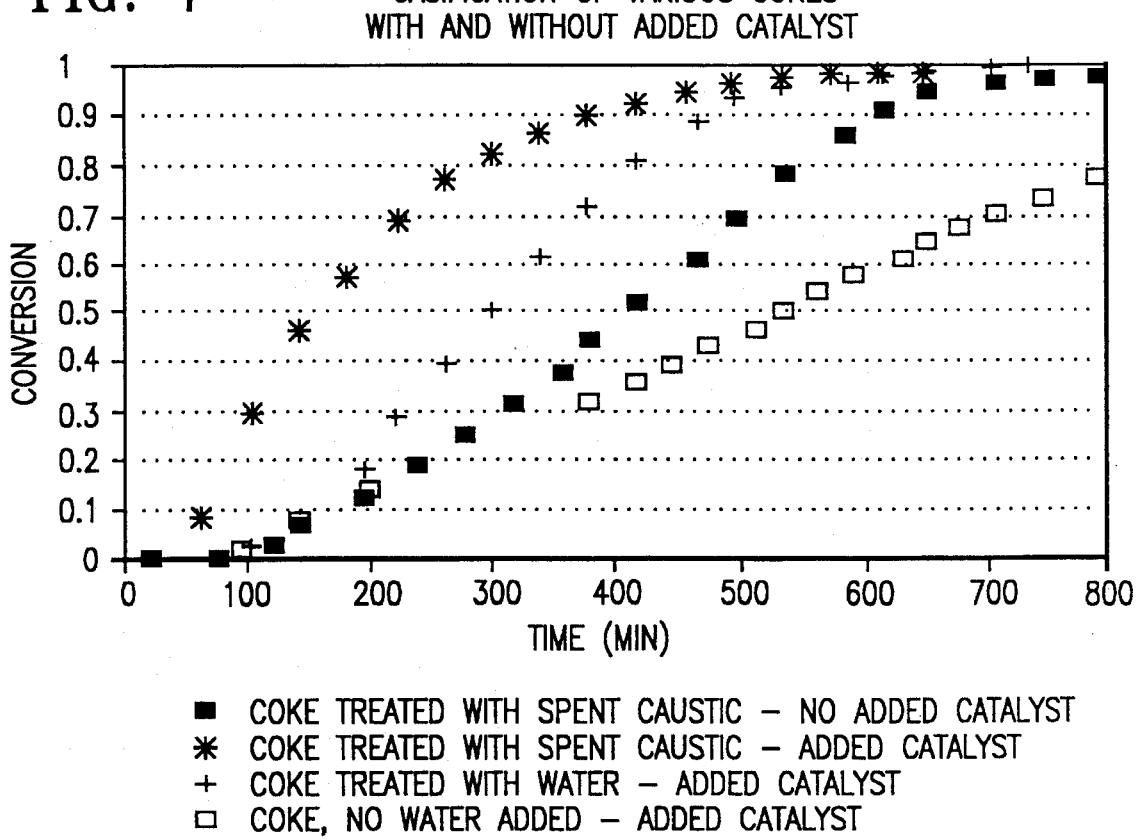

FIG. 7 compares the gasification of the cokes of Examples 4 and 6 with the coke of FIG. 3 in the absence of added catalyst and the coke of Example 6 in the presence of added catalyst.

The results of the gasifications carried out in the absence of added catalyst were superior to those carried out upon the coke of FIG. 3 which was gasified in the presence of added catalyst.

EXAMPLE 7

This example illustrates the gasification of cokes obtained with and without 7 weight percent aqueous sodium hydroxide under coking conditions of 840° F. and 12 psig for 2 hours. Catalyst, where employed, was 1% equimolar oxides of potassium and calcium. The results are graphically presented in FIG. 8. The data show that even where added catalyst was present, gasification of coke which had been obtained in the absence of caustic proceeded very slowly. However, where the coke had been obtained in the presence of caustic, gasification rates were excellent even where no externally added catalyst was present. When the same caustic-containing coke was gasified in the presence of added catalyst, further improvement in gasification rate was achieved.

EXAMPLE 8

Table 5 below illustrates the percent sodium and percent sulfur present in the residua of five different crudes. These residua are used as coker feeds. The addition of the same amount of caustic to different coker feeds results in different amounts of alkali and sulfur in the resultant coke as different coker feeds produce different amounts of coke and essentially all of the alkali is incorporated into the coke. Shown below are the results of coking five different residua (50 g) in the presence of the same amount of caustic (4 g). The different sodium levels in the resultant cokes is a result of different coke yields from the different resids. The sulfur levels reflect the nature of the organic components of the parent resid as well as the sulfur deposited from the waste caustic stream.

TABLE 5

| | wt % Na in Coke | | wt % S in Coke | |
|---|---|---|---|---|
| Resid | Parent | w/Caustic | Parent | w/Caustic |
| 1) Maya | 0.55 | 1.57 | 5.54 | 6.75 |
| 2) Torrance/Hondo | 0.14 | 4.61 | 2.24 | 2.56 |
| 3) Arab Light | 0.05 | 6.03 | 7.29 | 8.33 |
| 4) Zuluf | .01 | 6.02 | 7.71 | 9.18 |
| 5) Statfjord | 1.40 | 9.04 | 0.74 | 3.88 |

Examples 4–6 demonstrted that an increase in the concentration of caustic and sulfur added to a coker feed in a coking operation produced a coke product of decreased quality. Quality was expressed as crystallinity. The lower the quality of coke, however, the more readily it gasified. The absolute amount of sodium present in the coker feed does not correlate with the gasification rate, since Maya has only 1.57% Na and Torrance/Hondo has 4.61% yet Maya gasified more rapidly. In all cases, the amount of sulfur and caustic (alkali) in the coke is dramatically increased by the addition of aqueous waste streams to the coker feed. In order to provide satisfactory gasification, it is desirable that at least 0.5% sodium (or alkali) be incorporated into the final coke. Levels of sodium in coke that are over 20% are not desirable because of possible corrosion problems.

EXAMPLE 9

Figure 8:
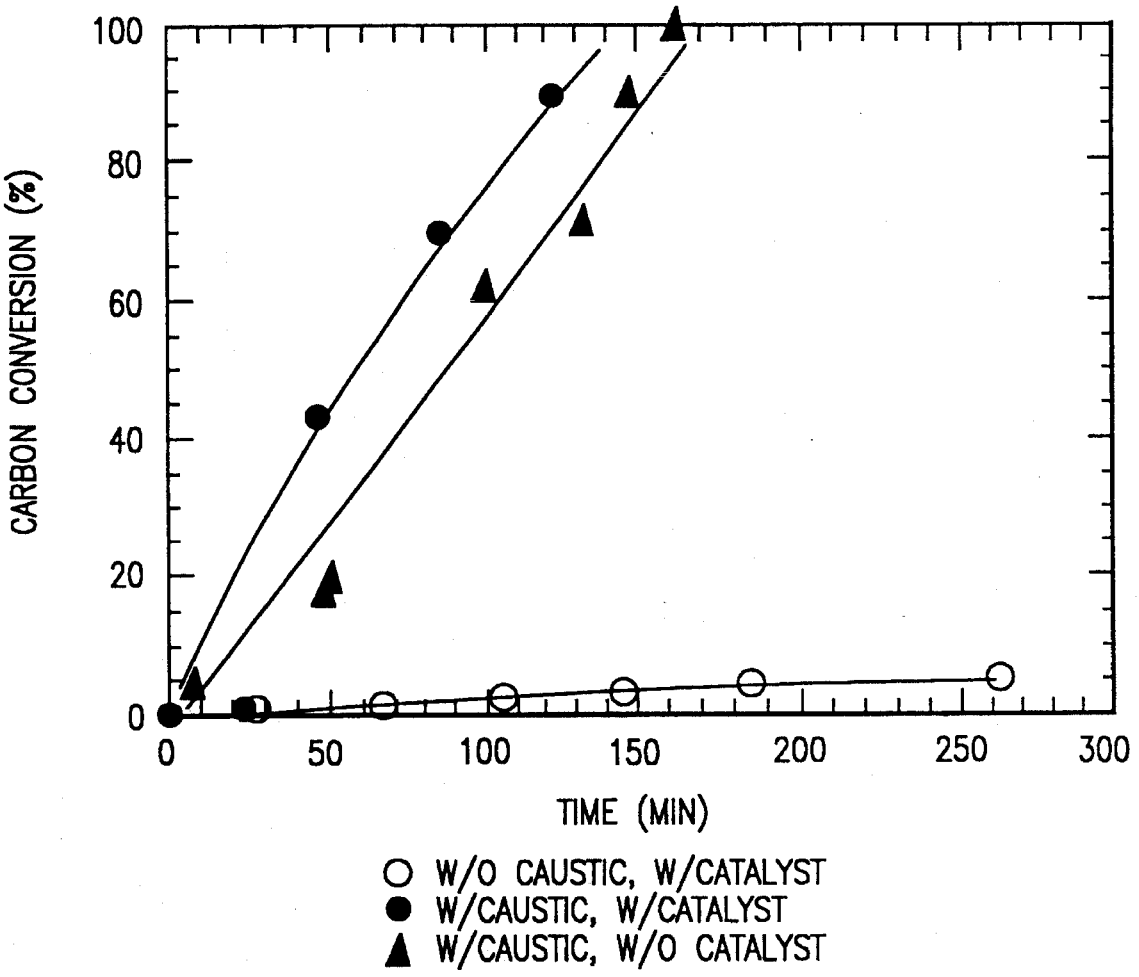

Table 6 illustrates three types of coker feed. In each case, when caustic was added during the coking operation, the coke produced was easier to gasify than cokes produced with no added caustic during the coking operation but 1 wt. % $CaO/K_2O$ added to the coke prior to gasification. All cokes were even more easily gasified if caustic was added during coking and 1 wt. % $CaO/K_2O$ was added to those cokes. FIGS. 7 and 8 also illustrate this.

TABLE 5

| | % Gasified in | | |
|---|---|---|---|
| Coke Type | 200 | 400 | 700 minutes |
| Maya (parent) | 1 | 2 | 3 |
| 1 wt. % $CaO/K_2$ only | 12 | 33 | 69 |
| caustic in coker | 13 | 50 | 96 |
| caustic/coker + 1 wt. % | 63 | 79 | 100 |

TABLE 5-continued

| Coke Type | % Gasified in 200 | 400 | 700 minutes |
|---|---|---|---|
| $CaO/K_2O$ | | | |
| Torrance/Hondo (parent) | <2 | | |
| 1 wt. % $CaO/K_2O$ only | 13 | | |
| caustic in coker | 42 | | |
| Statfjord (parent) | <1 | | |
| 1 wt. % $CaO/K_2O$ only | 10 | | |
| caustic in coker | 80 | | |

What is claimed is:

1. A coking process which may be used for the disposal of an aqueous waste material, comprising the following steps:

(a) reacting a coker feedstock under coking reaction conditions in the presence of an aqueous waste material, wherein the waste material is a caustic soda, caustic potash, or a mixture of both resulting from the refining of heavy hydrocarbons to lighter hydrocarbon products, containing from 0.4 wt % to 25 wt % of at least one sulfur-containing component, wherein the sulfur-containing component is selected from the group consisting of alkaline sulfide, hydrosulfide or mixture of both, which on gasification converts to hydrogen sulfide and at least one alkali-metal containing component, wherein the component is an alkali metal oxide, to provide a sulfur-containing and alkali metal containing coke product, wherein the coker feedstock comprises a hydrocarbon fraction having a boiling point of at least about 650° F. and wherein said coking reaction conditions include a temperature of from about 800° F. to about 930° F.; and (b) gasifying the coke product under gasification conditions in the presence of a catalyst, said catalyst comprising at least one metal oxide selected from the group consisting of alkali metal oxide and alkaline earth metal oxide, in order to convert (i) the coke to gaseous products (ii) the sulfur-containing component to hydrogen sulfide and (iii) the alkali metal -containing component to a solid residue.

2. The process of claim 1, wherein at least 0.5 wt. % alkali metal and no more than 20 wt. % alkali metal is incorporated into the coke product.

3. The process of claim 2, wherein less than about 5 wt. % alkali metal compound is present in the coker feedstock.

4. The process of claim 1 wherein the coke is quenched with a alkali metal-containing aqueous stream.

5. The process of claim 1 wherein the coke is quenched with a aqueous caustic soda, a caustic potash stream or mixture thereof.

6. The process of claim 1 wherein the sulfur-containing and alkali metal-containing waste material is a caustic soda, a caustic potash stream or mixture thereof.

7. The process of claim 1 wherein the coke product, being comprised predominantly of shot coke, is of low crystallinity.

8. The process of claim 1, wherein the coke is predominantly shot coke.

9. The process of claim 1 wherein gasifying is carried out in the presence of added gasifying catalyst comprising a mixture of at least one alkali metal oxide and at least one alkaline earth metal oxide.

10. The process of claim 9 wherein gasifying is carried out in the presence of added gasifying catalyst comprising a mixture of potassium and calcium oxide.

11. The process of claim 9 wherein gasifying is carried out in the presence of added gasifying catalyst comprising a eutectic mixture of at least one alkali metal oxide and at least one alkaline earth metal oxide.

12. The process of claim 11 wherein gasifying is carried out in the presence of added gasifying catalyst comprising a eutectic mixture of potassium oxide and calcium oxide.

13. The process of claim 1 wherein coking is carried out at a pressure of from abut 0 to about 100 psig.

14. The process of claim 1 wherein gasifying is carried out in the presence of steam at a temperature of from abut 550C(1022° F.) to about 700C(1292° F.) and from about atmospheric pressure to about 2000 psig.

15. The process of claim 1 wherein coking is carried out under delayed coking or flexicoking conditions.

16. The process of claim 4 wherein the alkali metal containing aqueous stream is heated in a dedicated heater.

17. The process of claim 15 wherein the coker feedstock is a vacuum resid.

18. The process of claim 15 wherein the coking is carried out under delayed coking conditions and the sulfur-containing and alkali metal-containing waste material is introduced to the delayed coking drum at an elevated coking temperature.

19. A coking process which may be used for the disposal of an aqueous waste material, which comprises:

(a) coking a coker feedstock under coking reaction conditions in the presence of an aqueous waste material, wherein the waste material is a caustic soda, caustic potash, or a mixture of both resulting from the refining of heavy hydrocarbons to lighter hydrocarbon products, containing from 0.4 wt % to 13 wt % of at least one sulfur-containing component, wherein the sulfur-containing component is selected from the group consisting of alkaline sulfide, hydrosulfide or a mixture of both, which on gasification converts to hydrogen sulfide and at least one alkali-metal containing component, wherein the component is an alkali metal hydroxide, to provide a sulfur-containing and alkali metal containing coke product, wherein the coker feedstock comprises a hydrocarbon fraction having a boiling point of at least about 650° F. and wherein said coking reaction conditions include a temperature of from about 800° F. to about 930° F.; and (b) gasifying the coke product under gasification conditions in the presence of a catalyst, said catalyst comprising at least one metal oxide selected from the group consisting of alkali metal oxide and alkaline earth metal oxide, in order to convert (i) the coke to gaseous products (ii) the sulfur-containing component to hydrogen sulfide and (iii) the alkali metal-containing component to a solid residue.

* * * * *